United States Patent [19]

Kobiella

[11] Patent Number: 4,661,185

[45] Date of Patent: Apr. 28, 1987

[54] METHOD AND APPARATUS FOR HEAT SEALING STRAP IN A STRAPPING MACHINE

[75] Inventor: Robert J. Kobiella, Rolling Meadows, Ill.

[73] Assignee: Signode Corporation, Glenview, Ill.

[21] Appl. No.: 708,401

[22] Filed: Mar. 5, 1985

[51] Int. Cl.[4] ..... B65B 13/04; B65B 13/32

[52] U.S. Cl. ..... 156/212; 53/399; 53/589; 100/26; 100/29; 100/33 PB; 156/229; 156/250; 156/308.2; 156/468; 156/495; 156/499; 156/510

[58] Field of Search ..... 156/494, 495, 157, 159, 156/212, 229, 468, 502, 250, 510, 308.2, 499; 100/26, 29, 32, 33 PB; 53/399, 582, 589

[56] References Cited

U.S. PATENT DOCUMENTS

| | | | |
|---|---|---|---|
| 3,200,028 | 8/1965 | Chisholm | 156/499 |
| 3,368,323 | 2/1968 | Wood | 100/33 PB |
| 3,397,105 | 8/1968 | Takami | 100/33 PB |
| 3,442,203 | 5/1969 | Kobiella | 100/26 |
| 3,771,436 | 11/1973 | Sato | 156/502 |
| 3,841,055 | 10/1974 | Takami | 100/33 PB |
| 3,914,153 | 10/1975 | Sato | 156/499 |
| 4,016,023 | 4/1977 | Takami | 156/502 |
| 4,050,372 | 9/1977 | Kobiella | 156/73.5 X |
| 4,409,058 | 10/1983 | Suwabe et al. | 100/33 PB |

FOREIGN PATENT DOCUMENTS

| | | |
|---|---|---|
| 2363275 | 6/1974 | Fed. Rep. of Germany . |
| 49-4520 | 2/1974 | Japan . |

*Primary Examiner*—Michael Wityshyn

*Attorney, Agent, or Firm*—Dressler, Goldsmith, Shore, Sutker & Milnamow, Ltd.

[57] ABSTRACT

A method and apparatus is provided for securing together overlapping portions of a thermoplastic strap loop around an object. After the strap is fed to form the loop, the upper strap portion is restrained while pulling the strap trailing portion to tension the loop. Lengths of the upper and lower strap portions are then gripped together in face-to-face contact to hold the loop in tension. The trailing portion is severed from the loop lower strap portion, and the restraint of the upper strip portion is terminated. A heating member is extended between the upper and lower strap portions in a direction generally parallel to the strap length. The upper and lower strap portions are pressed against the heating member to melt regions of the strap. The heating member is withdrawn, and the melted regions are pressed together as the melted regions solidify to form a joint. Included in the apparatus are coacting first and second gripper means, an anvil, a cutter, and a heating member. One of the gripper means defines a strap length receiving region below at least a portion of the gripping means for accomodating the lower strap portion prior to severing the trailing portion of the strap.

7 Claims, 18 Drawing Figures

FIG. 1
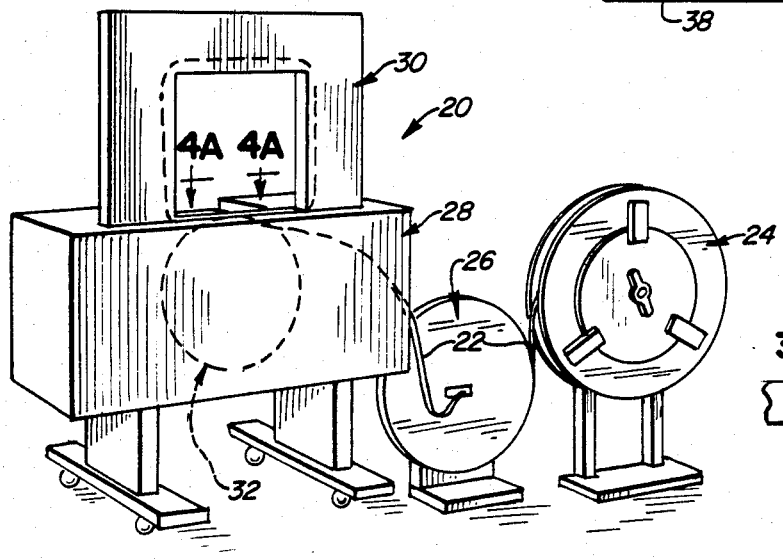
FIG. 2A
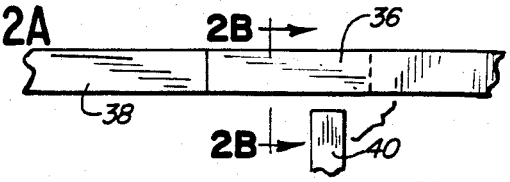
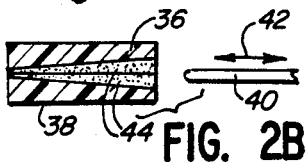
FIG. 2B
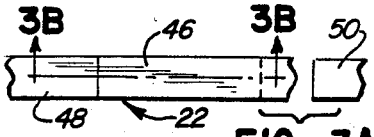
FIG. 3A
FIG. 3C
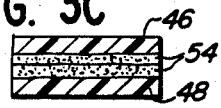
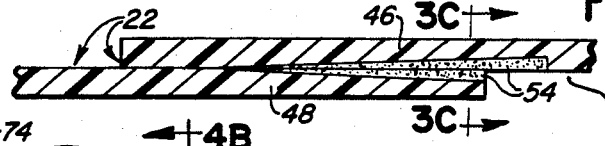
FIG. 3B
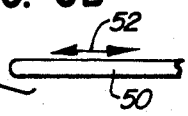
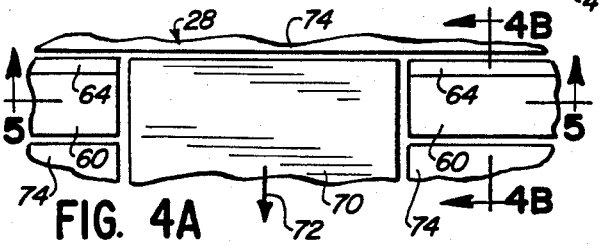
FIG. 4A
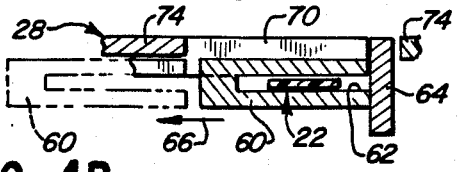
FIG. 4B
FIG. 13
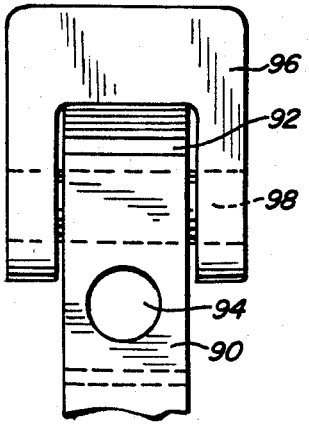
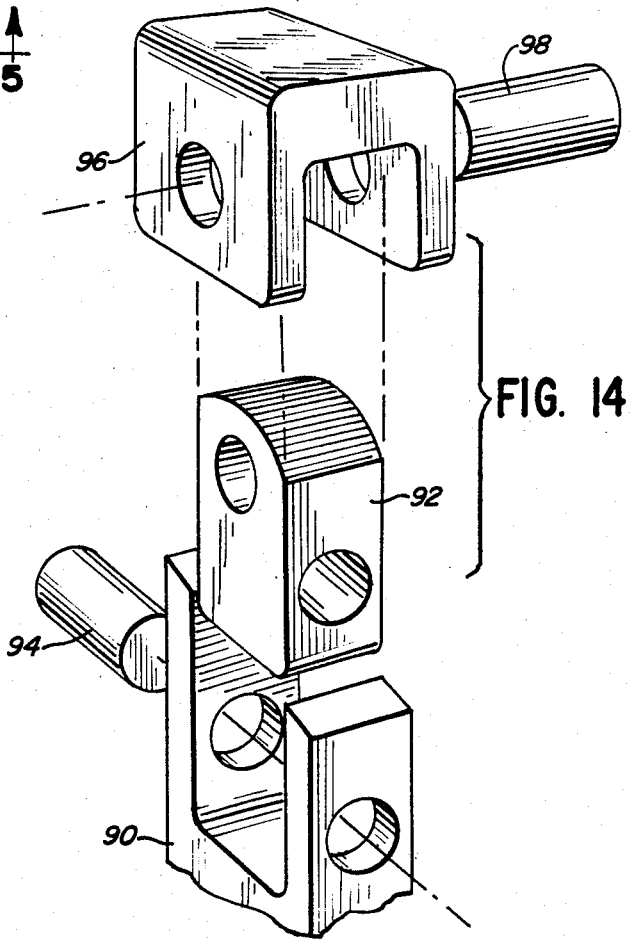
FIG. 14

METHOD AND APPARATUS FOR HEAT SEALING STRAP IN A STRAPPING MACHINE

TECHNICAL FIELD

This invention relates to a method and apparatus for securing together overlapping portions of thermoplastic strap.

BACKGROUND OF THE INVENTION AND TECHNICAL PROBLEMS POSED BY THE PRIOR ART

Machines have been developed for forming a tensioned loop of thermoplastic strap around an object. Such machines typically include means for forming the loop about the object, means for pulling the strap loop trailing portion to tension the strap loop about the object, means for securing the overlapping strap portions together by melting and resolidifying regions of the strap, and means for severing the strap trailing portion from the loop.

One such machine is sold under the designation "MODEL MS POWER STRAPPING MACHINE" in the U.S.A. by Signode Corporation, 3600 West Lake Ave., Glenview, Ill. 60025, U.S.A. In this machine the strap is first manually looped around the object and the loop is then automatically tensioned. The overlapping strap portions are joined together after severing the trailing portion of the strap from the loop. This is effected with a heated member which moves from a retracted position spaced away from the overlapping strap portions to an extended position between the overlapping strap portions. The heated member moves in a direction generally perpendicular to the strap length. Although this works well in the applications for which it has been designed, the depth of the joint weld is not constant along the transverse cross sections of the overlapping strap portions. Since the heated member travels transversely relative to the width of the overlapping strap portions, the portions of the strap along one edge are necessarily in contact with the heated member for a longer period of time than the portions of the strap portions along the other edge of the strap. Although a central portion of the completed weld typically has the desired depth, the thickness of the weld at one edge may be less than desired while the thickness of the weld at the other edge may be more than desired.

Methods and apparatus have been proposed for welding overlapping strap portions together with a heated member moved between the overlapping strap portions in a direction generally parallel to the length of the strap. This eliminates the variation in the weld depth profile across the width of the overlapping strap portions. U.S. Pat. Nos. 3,368,323 and 3,397,105 disclose hand tools for effecting such a weld with a heated member. However, the disclosed hand tools do not automatically feed the strap around the object to be bound with the strap. Rather, the strap must be manually formed into a loop around the object, and the strap must be manually inserted in the proper position among the mechanisms comprising each hand tool.

It would be desirable to provide an improved method and apparatus for welding overlapping strap portions together with a heated member in an automatic strapping machine of the type having strap loop feeding and tensioning mechanisms.

It would also be advantageous to provide a method and apparatus for effecting a welded joint of overlapping thermoplastic strap portions with a heated member in a manner that would permit the width of the strapping machine to be reduced. This would permit conveyor systems to be located closer to the path of the strap loop and would permit multiple machines to apply strap to an object in a more closely spaced array.

Further, it would be desirable to provide an improved method and apparatus of the type described that would also produce a welded joint that is of substantially uniform thickness in transverse cross section at any selected point along the length of the welded joint.

SUMMARY OF THE INVENTION

According to the disclosed method, a tensioned loop of thermoplastic strap is formed around an object. The strap is fed to form the loop having overlapping upper and lower strap portions and a trailing portion of the strap extending from the loop. The upper strap portion is restrained while the strap trailing portion is pulled to tension the loop. Lengths of the upper and lower strap portions are then gripped together in face-to-face contact to hold the loop in tension during subsequent steps. Next, the trailing portion of the strap is severed from the loop lower strap portion, and the restraining of the upper strap portion and the pulling on the strap trailing portion is terminated.

A heating member is then extended between the upper and lower strap portions in a direction generally parallel to the strap length. The upper and lower strap portions are pressed against the heating member whereby regions of the upper and lower strap portions melt. The heating member is then withdrawn from between the upper and lower strap portions. Finally, the melted regions of the upper and lower strap portions are pressed together in face-to-face contact as the melted regions of the upper and lower strap portions solidify to form a joint.

A strap gripping and sealing assembly is provided for carrying out the above-described method in a strapping machine of the type that has (1) means for feeding thermoplastic strap around an object to form a loop having upper and lower strap portions and a trailing portion of strap extending from the loop and (2) means for pulling the strap trailing portion to tension the loop about the object.

An anvil is provided on the machine adjacent a path in which the upper and lower strap portions can be positioned. One gripper means is provided on the machine for being moved (1) away from the anvil to accommodate the feeding of the upper and lower strap portions above the one gripper means and (2) toward the anvil to urge the upper strap portion against the anvil. A movable cutter means is provided on the machine for severing the strap trailing portion from the lower strap portion. Another gripper means is provided on the machine for being moved (1) away from the anvil and (2) toward the anvil to urge the strap portions toward the anvil. The other gripper means is disposed between the one gripper means and the cutter means. The other gripper means also defines a strap length receiving region below at least a portion of the other gripper means for accommodating the lower strap portion. Finally, a heating member is provided on the machine for melting regions of the upper and lower strap portions. The heating member is movable in directions parallel to the strap length between an extended position in registry with the anvil and a retracted position out of registry with the anvil.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a simplified, perspective view of a strapping machine embodying the apparatus of the present invention for effecting the method of the present invention;

FIG. 2A is a greatly enlarged, fragmentary, diagrammatic, plan view of overlapping strap portions and a heating member for making a conventional welded joint by movement between the overlapping strap portions in directions generally transversely of the strap length;

FIG. 2B is an even more greatly enlarged, fragmentary, cross-sectional view taken generally along the plane 2B—2B in FIG. 2A;

FIG. 3A is a greatly enlarged, fragmentary, plan view of overlapping strap portions welded together in accordance with the teachings of the present invention and showing a heating member adapted for moving in directions generally parallel to the length of the strap;

FIG. 3B is an even more greatly enlarged, fragmentary, cross-sectional view taken generally along the plane 3B—3B in FIG. 3A;

FIG. 3C is a cross-sectional view taken generally along the plane 3C—3C in FIG. 3B;

FIG. 4A is a greatly enlarged, fragmentary, plan view taken generally along the plane 4A—4A in FIG. 1;

FIG. 4B is a fragmentary, cross-sectional view taken generally along the plane 4B—4B in FIG. 4A;

FIG. 13 is a fragmentary, elevational view taken generally along the plane 13—13 in FIG. 5 to illustrate the self-aligning strap gripper means; and FIG. 14 is an exploded, perspective view of the gripper means of FIG. 13.

DESCRIPTION OF THE PREFERRED EMBODIMENT

Figure 5:
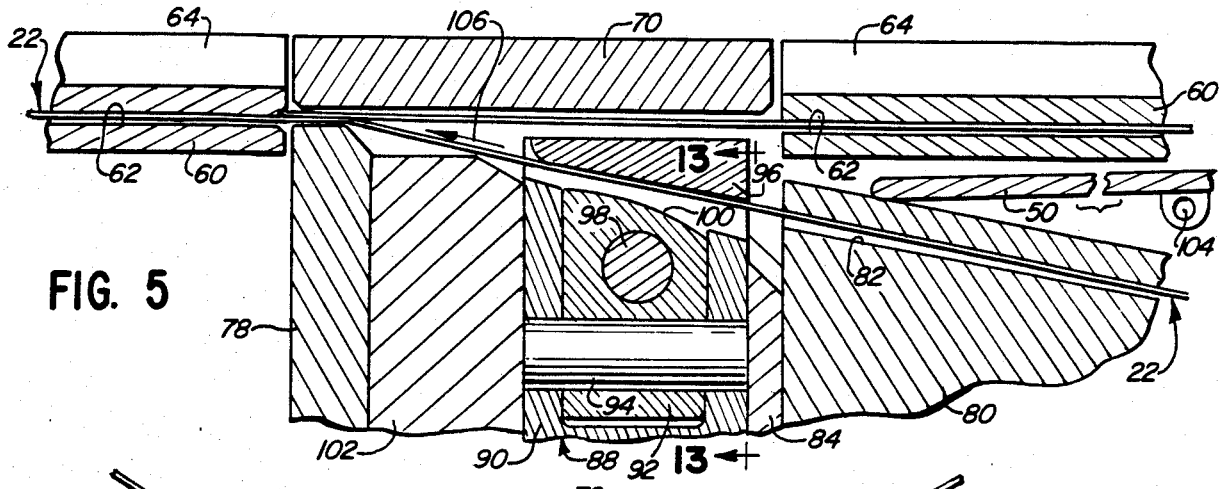
FIGS. 5–12 are simplified, cross-sectional views generally illustrating the method and apparatus of the present invention and in particular the strap gripping and sealing assembly components of the apparatus illustrated in FIG. 1.

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, used, and sold in an orientation other than the position described.

The apparatus of this invention is adapted to be used in a strapping machine with certain conventional components the details of which, although not fully illustrated or described, will be apparent to those having skill in the art and an understanding of the necessary functions of such components.

Some of the figures illustrating the embodiment of the apparatus show structural details and mechanical elements that will be recognized by one skilled in the art. However, the detailed descriptions of such elements are not necessary to an understanding of the invention, and accordingly, are not herein presented.

Referring now to the drawings, the novel apparatus of the present invention may be incorporated in an automatic strapping machine 20 as shown in its entirety in FIG. 1. Strap 22 is fed to the machine 20 from a dispenser 24 through an accumulator 26. The dispenser 24 and accumulator 26 may be of a special or conventional design.

A conventional dispenser is disclosed in the U.S Pat. No. 3,602,452. A conventional dispenser and accumulator assembly is employed with the power strapping machines sold in the U.S.A. under the designations ML2-EE, ML2-JE, and ML2-HG by Signode Corporation, 3600 West Lake Ave., Glenview, Ill. 60025, U.S.A. and is described in the "OPERATION, PARTS AND SAFETY MANUAL" for such machines as published by Signode Corporation under the designation "186152 REV 9/84". The use of an accumulator and/or dispenser per se is not necessary to the invention described and claimed herein, and the specific details of the dispenser 24 and accumulator 26 form no part of the present invention.

The strap 22 is fed through a lower housing 28 of the machine 20 and around a chute 30 on top of the housing 28. The housing 28 defines an object receiving station in which is placed the object (not illustrated) that is to be bound with the strap. The chute 30 may be of a special design or may be of a conventional design. Conventional chute designs are disclosed in the West German patent Auslegeschrift No. 1 211 102 and in the U.S. Pat. No. 3,060,840. Another conventional chute design is incorporated in the power strapping machine marketed in the U.S.A. under the designation "MCD 700/300" by Signode Corporation, 3600 West Lake Ave., Glenview, Ill. 60025 U.S.A., and is disclosed in the "OPERATION, PARTS AND SAFETY MANUAL" for that machine as published by Signode Corporation under the document designation "186161 Rev. 3/84". The detailed design and specific structure of the chute 30 incorporated in the machine 20 described herein forms no part of the present invention.

In the lower housing 28 of the machine 20 there are appropriate strap feeding and tensioning mechanisms (not illustrated). Such mechanisms first feed the strap 22 into the chute 30 to form the loop and then subsequently tension the strap 22 tight about the object. The feeding and tensioning assembly may be of a special design or may be of a conventional design.

One such conventional design employing a feed wheel and a tension wheel is incorporated in the above-described Signode Corporation power strapping machine sold under the designation "MCD 700/300." Another conventional feeding and tensioning assembly is incorporated in the power strapping machine sold in the U.S.A. under the designation "MODEL MS" by Signode Corporation, 3600 West Lake Ave., Glenview, Illinois 60025 U.S.A and is also described in the "OPERATION AND SAFETY MANUAL" for that machine as published by Signode Corporation under the document designation "E-186173 9/81-1M-SS." Another type of conventional strap feeding and tensioning assembly is disclosed in the U.S. Pat. No. 4,011,807. The details of the particular design and configuration of the feeding and tensioning assembly in the strapping machine 20 for operating in accordance with the teachings of the present invention form no part of the present invention.

The strap gripping and sealing assembly of the present invention for use in the strapping machine 20 is located in the machine lower housing 28 below the chute 30 and generally in the region identified by the dashed line circle 32 in FIG. 1. The assembly includes various anvil, gripper, cutter, and heating member components, and such components are described in detail hereinafter.

FIGS. 2A and 2B illustrate a prior art or conventional method for welding overlapping strap portions together with a heated member, such as is practiced by the above-discussed Signode Corporation MODEL MS power strapping machine. In particular, the strap is formed into a loop with an upper strap portion 36 and a lower strap portion 38. A heating member, such as a heated blade 40, is disposed on one side of the overlapping strap portions and is adapted to move transversely of the strap length in the two opposite directions indicated by the double-headed arrow 42 in FIG. 2B.

In operation, the upper and lower strap portions 36 and 38, respectively, are initially spaced apart, and the heated blade 40 is moved from the retracted position (illustrated in FIGS. 2A and 2B) to an extended position between the strap portions. Then force is applied to the arrangement so that the upper strap portion 36 is pressed against the upper surface of the heated blade 40 while the lower strap portion 38 is pressed against the lower surface of the heated blade 40. Next, the heated blade 40 is withdrawn, leaving melted regions 44 (FIG. 2B) of the strap portions. The strap portions are further squeezed together in face-to-face contact while the melted regions 44 solidify to form a welded joint.

As the heated blade 40 is extended between, and withdrawn from, the overlapping strap portions 36 and 38, parts of the strap portions at the one edge of the strap closer to the retracted position of the blade 40 are necessarily in contact with the blade 40 for a longer period of time than are the parts of the strap portions at the other edge of the strap. Consequently, the strap portions will not be uniformly heated across the transverse width of the strap. More melting will occur at one edge of the strap than at the other edge of the strap. The depth of the melted weld regions 44 in each of the overlapping strap portions will thus increase from one edge of the strap to the other edge of the strap as illustrated in FIG. 2B.

The present invention, which can be effected in a completely automatic power strapping machine, provides a heating member and other associated components, as described in detail hereinafter, which form a weld between overlapping strap portions wherein the depth of the weld does not vary substantially across the width of the strap at any selected location along the length of the weld. This is best illustrated in FIGS. 3A, 3B, and 3C wherein an upper overlapping strap portion 46 of strap 22 is shown welded to a lower strap portion 48.

According to this method, a heating member 50 is movable in opposite directions indicated by the double headed arrow 52 in FIG. 3B. Specifically, the heating member 50 is movable longitudinally, in directions parallel to the length of the strap 22, between the retracted position illustrated in FIGS. 3A and 3B and an extended position between the overlapping strap portions 46 and 48.

Initially, the strap portions are spaced apart sufficiently to receive the heating member 50 in the extended position. Force is then applied in a manner to urge the strap portions against the heating member 50 to cause melting of regions 54 of the strap portions 46 and 48. The heating member 50 is then withdrawn, and the strap portions are squeezed together in face-to-face contact as the melted portions solidify to form the welded joint. As the heating member 50 is retracted from between the overlapping strap portions, the parts of the overlapping strap portions closest to the retracted position of the heating member 50 necessarily remain in contact longer with the heating member 50 than do the other parts of the overlapping strap portions. Thus, the depth to which each overlapping strap portion is melted varies along the length of the strap as illustrated best in FIG. 3B.

Although the weld profile varies along the length of the strap 22, it is to be realized that at any point along the length of the strap in the weld region, the depth of the weld in each strap portion 46 and 48 is substantially constant in the transverse direction across the width of each strap portion. The transverse cross-sectional profile of the weld has a substantially rectangular configuration (FIG. 3C), and the depth is uniform from one side of the strap 22 to the other side at any selected longitudinal location along the weld length.

The heating member 50, along with the other mechanisms comprising the strap gripping and sealing assembly for the machine 20, are illustrated in more detail in FIGS. 4A, 4B, 5–14. At the horizontal top surface of the housing 28, as best illustrated FIGS. 4A, 4B, and 5, the strap chute 30 has appropriate strap receiving sections 60 which each define a slot or channel 62 for receiving the strap 22. Any suitable strap receiving section structure may be provided. However, for purposes of describing the present invention, there is illustrated in FIGS. 4A et seq. a specific embodiment of the strap receiving section 60 that has a generally sideways oriented, U-shaped configuration.

The opening of channel 62 in each section 60 is normally blocked by retaining members 64. These retain the strap 22 in the channel 62 when the section 60 is in the position illustrated in solid line in FIG. 4B.

Each strap receiving section 60 is movable in the direction of the arrow 66 to a retracted position illustrated by the dashed lines in Figure 4B. In the retracted position, the section 60 is spaced from the retaining member 64, and the strap 22 is free to be pulled out of the slot 62 against the object being bound.

The means for moving the strap receiving sections 60 between the two positions illustrated in FIG. 4B may be of any suitable conventional design (e.g., electric solenoid operators, hydraulic operators, or other mechanical drive mechanisms) the details of which form no part of the present invention.

To provide a convenient support surface for an object being bound, the machine lower housing 28 preferably includes generally horizontally disposed support plates 74 which each define an upper horizontal surface at substantially the same elevation as the upper horizontal surface of the anvil 70 and members 64.

An anvil 70 is provided between two spaced-apart strap receiving sections 60 as illustrated in FIGS. 4A and 5. The anvil 70 is also movable, in the direction indicated by the arrow 72 in FIG. 4A, from an extended position over the path of the strap 22 to a retracted position which will permit the strap 22, after the strap loop has been tensioned and welded, to snap upwardly tight against the bottom of the object being bound.

The anvil 70 may be moved between the extended position illustrated in FIGS. 4A and 4B and the fully retracted position (not illustrated) by suitable special or conventional mechanisms (not illustrated). The details of the means for effecting such anvil movement form no part of the present invention.

Novel strap gripping and severing mechanisms are provided below the anvil 70 as best illustrated in FIGS. 5–14. These mechanisms are retained and guided on one end by a vertical plate 78 and on the other end by a vertical plate 80. The plate 80 also defines a slot or guideway 82 for accommodating the strap 22.

Figure 8:
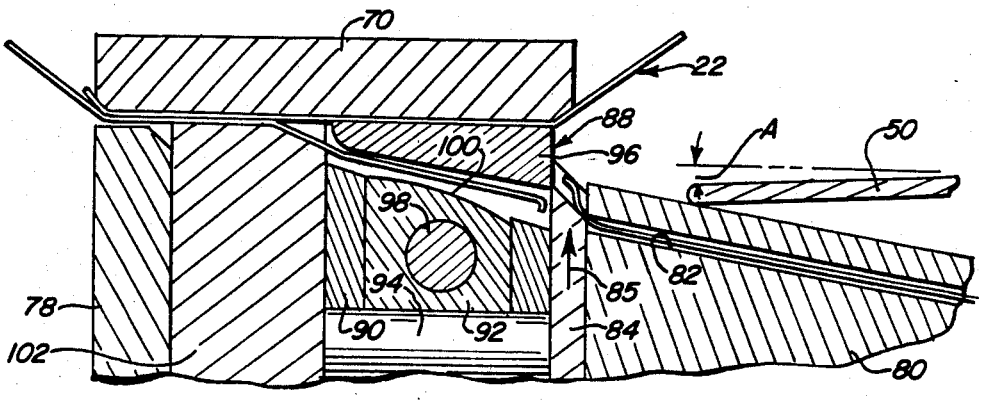
Figure 9:
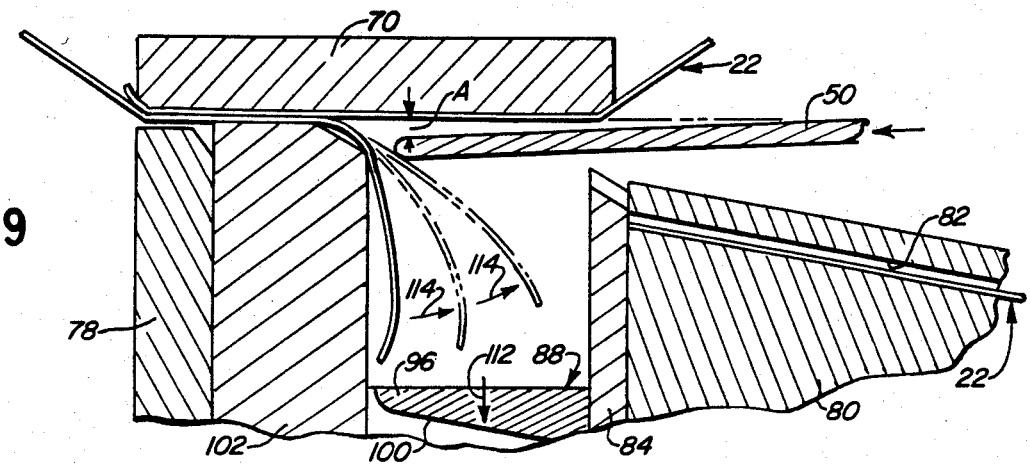
Figure 10:
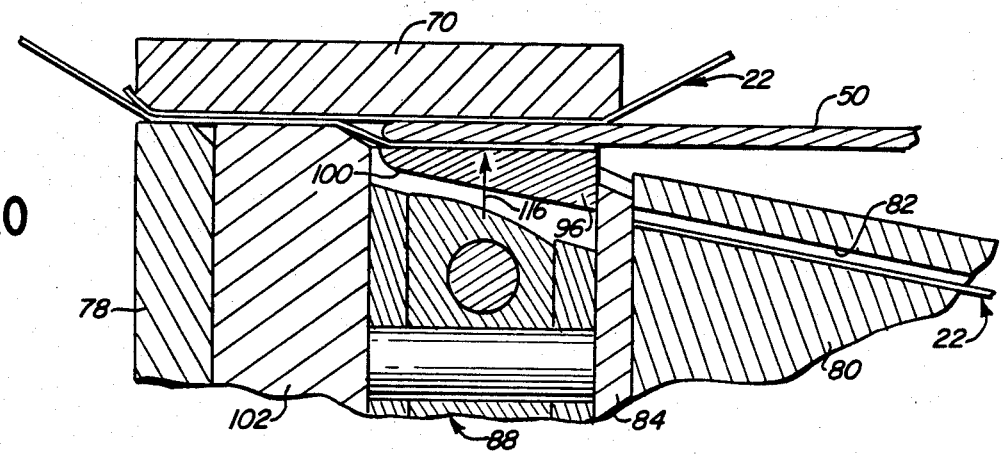

Slidably disposed adjacent the plate 80 is a strap cutter means or cutter member 84. The cutter member 84 is normally in a fully lowered or retracted position as illustrated in FIGS. 5–7 and 12. However, the cutter member 84 is movable upwardly (as indicated by arrow 85 in FIG. 8) from a first or initial elevation position through a range of higher elevations as illustrated in FIGS. 8–10. As illustrated by the arrow 86 in FIG. 11, the cutter member 84 is movable downwardly from its position of maximum elevation in FIG. 10 to the lowest, fully retracted position illustrated in FIG. 12.

Adjacent the cutter member 84 there is a gripper means 88 which is (1) movable away from the anvil 70 to accommodate the feeding of the strap 22 and (2) movable toward the anvil 70 to urge a portion of the strap against the anvil 70. As best illustrated in FIGS. 5, 13, and 14, the gripper means 88 includes a movable support 90 and a block 92 pivotally mounted to the support 90 by means of a pin 94 for rotation about an axis generally parallel to the strap length.

The gripper means 88 also includes a first gripper member 96 pivotally mounted by means of a pin 98 to the block 92 for rotation about an axis generally normal to the strap length. The first gripper member 96 and the block 92 cooperate to define a passageway 100 (FIGS. 5–12) in a strap length receiving region defined below the first gripper member 96.

The pinned connections of the components of the gripper means 88 serve to permit a self-alignment of the first gripper member 96 with the anvil 70 when the gripper means 88 is elevated against the anvil 70 as described in detail hereinafter.

The gripper means 88 is movable through a range of elevations illustrated in FIGS. 5–12 by suitable special or conventional means or mechanisms the details of which form no part of the present invention.

Another gripper means, or second gripper member, 102 is provided between the plate 78 and the first gripper means 88. The gripper member 102 is movable, between a retracted or lowered position illustrated in FIGS. 5, 6, and 12 and an elevated position illustrated in FIGS. 7–11, by suitable special or conventional means or mechanisms the details of which form no part of the present invention.

The means or mechanisms for effecting movement of the anvil 70, gripper means 88, gripper means 102, and cutter 84 may be of special or conventional designs. Conventional mechanisms that might be adapted for effecting the required movement could include hydraulic actuators, mechanical linkages driven from rotating members, and the like. Mechanisms for extending and retracting gripper members, anvils, and cutter members are employed in the above-described Signode Corporation MODEL MS power strapping machine as disclosed in the above-identified Signode Corporation "OPERATION AND SAFETY MANUAL" document designated E-186173 9/81-1M-SS and in the above-discussed Signode Corporation MCD 700/300 power strapping machine as disclosed in the above-identified Signode Corporation "OPERATION, PARTS, AND SAFETY MANUAL" document designated "186161 Rev. 3/84". Such conventional mechanisms, or other conventional mechanisms, may be adapted to provide the vertical movement for the present invention cutter member 84, gripper means 88, gripper member 102, and anvil 70.

The heating member 50 is normally maintained in a retracted position from, and out of registry with, the anvil 70 as best illustrated in FIG. 5. The heating member 50 is movable in directions parallel to the strap length between the retracted position and an extended position in vertical registry below the anvil 70 (as best illustrated in FIG. 10). Preferably, the heating member 50 is cantilevered from a support pin 104 (FIG. 5 only) in a suitable movable support structure (not illustrated). As best illustrated in FIG. 8, the heating member 50 is preferably cantilevered at a small angle A below the horizontal and can assume a substantially horizontal orientation in the fully extended position as illustrated in FIG. 10.

The heating member 50 may be of conventional design and capable of maintaining temperatures up to about 800° F. Conventional heating member designs are disclosed in the U.S. Pat. Nos. 3,368,323 and 3,397,105. Another conventional heating member design, which can be readily adapted for use in the present invention, is employed on the above-identified Signode Corporation MODEL MS power strapping machine and is described in the above-identified Signode Corporation "OPERATION AND SAFETY MANUAL" document designated "E186173 9/81-1M-SS". An appropriate special design for the heating member, as well as other conventional designs, may be adapted for use in the present invention. The details of the heating member design and of its actuating mechanisms form no part of the present invention.

The above-described components of the strap gripping and sealing assembly are designed to operate to effect a novel process of providing a tensioned loop of thermoplastic strap around an object. To effect this method with these mechanisms in an automatic power strapping machine, the mechanisms are initially positioned as shown in FIG. 5 prior to initiating the strapping cycle.

The object to be bound, which is not illustrated, would be placed on the machine lower housing over the extended anvil 70. The gripper means 88 is at a first elevation position as shown in FIG. 5 wherein the first gripper member 96 is spaced below the anvil 70. The top horizontal surface of the first gripper member 96 is at or slighlty below the bottom horizontal surface of the channel 62 in the strap receiving sections 60. The cutter member 84 and the second gripper member 102 are each in a fully lowered position. The heating member 50 is also in a fully retracted position adjacent the first gripper member 96 at an elevation below the anvil 70.

The strap 22 is then fed, by suitable strap feeding means (not illustrated), through the slot 82 in plate 80 (in the direction of arrow 106 in FIG. 5) and through the passageway 100 in the gripper means 88. The strap 22 continues from the gripper means 88, over the second gripper member 102, over the end of plate 78, and into the chute strap receiving section 60. The strap 22 travels around the object in the chute 30 (FIG. 1) to form a loop with the distal end of the strap returning to pass over the top of the first gripper member 96 (FIG. 5). The strap leading end ultimately slides over the underlying portion of strap and abuts an end of one of the strap receiving sections 60 adjacent the anvil 70 as illustrated in FIG. 5.

When the distal end of the strap 22 has impinged against the chute strap receiving section 60 as illustrated in FIG. 5, the feeding of the strap is terminated. This may be effected through conventional means, such as timers or strap location sensing switches (not illustrated) forming part of the strap feed control system.

In FIG. 5 it can be seen that, upon termination of the strap feeding, a loop is formed with overlapping upper and lower strap portions. The upper strap portion extends below the anvil 70 and above the second gripper 102. The upper strap portion also extends below the anvil 70 and above both the first gripper member 96 and heating member 50.

The lower strap portion extends between the second gripper member 102 and the upper strap portion. The lower strap portion also extends below the first gripper member 96 (through passageway 100) in registry with the upper strap portion. The trailing portion of the strap extends over the cutter member 84 and below the heating member 50 where the strap is received in the slot 82.

In the next step of the strapping process, the first gripper member 96 is raised (in a direction of the arrow 108 in FIG. 6) to a second elevation position to press the upper strap portion against the bottom anvil 70 to grip or restrain the upper strap portion. In a preferred form of the method, the upper strap portion is pressed against the anvil 70 by the gripper member 96 with a force of about 500–600 pounds.

Figure 6:
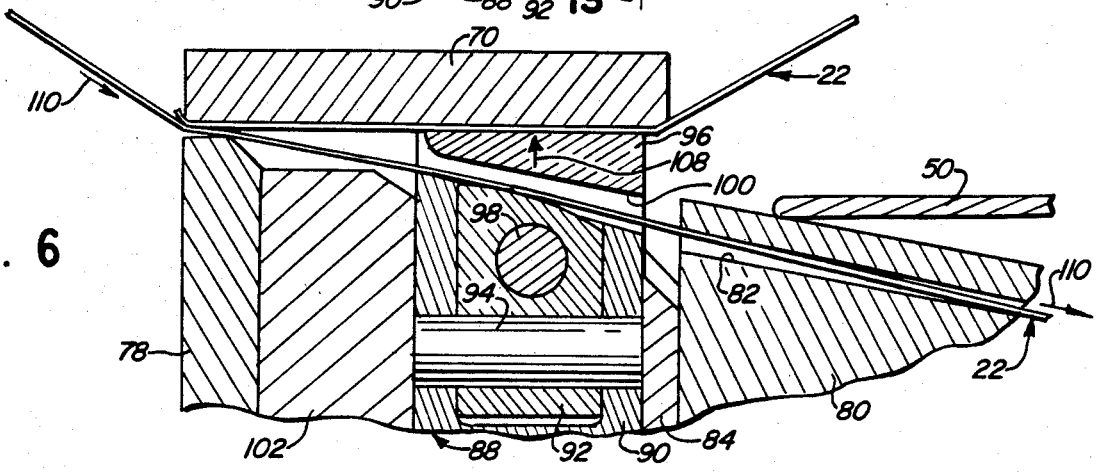
Figure 7:
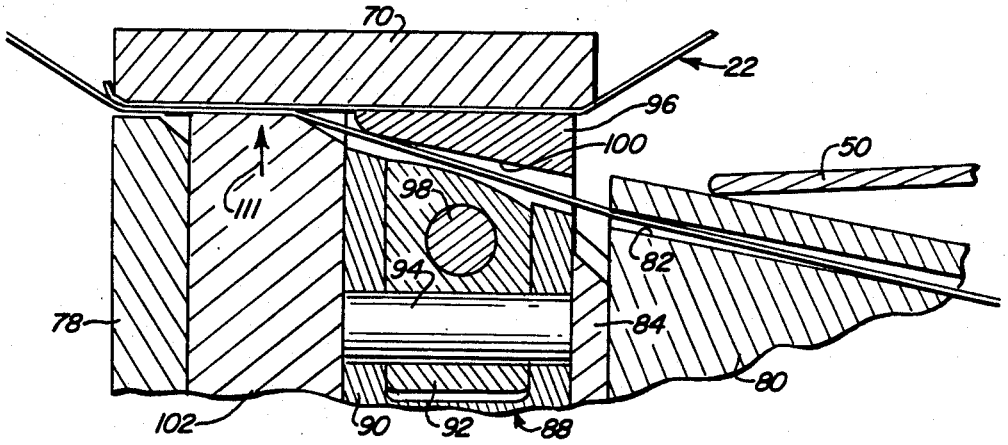

Next, the loop is tensioned around the object by pulling the strap trailing portion in a direction opposite from the strap feeding direction. This tension pulling direction is indicated in FIG. 6 by the arrows 110. As the loop is tensioned, the strap receiving sections 60 are retracted (as illustrated in FIG. 4B) to release the strap 22 which is pulled tight around the exterior of the object being bound.

Next, the second gripper member number 102 is raised in the direction of arrow 111 (FIG. 7) to an elevated position for pressing the lower strap portion and the upper strap portion together against the anvil 70 to hold the strap loop in tension.

Then, as illustrated in FIG. 8, the trailing portion of the strap is severed from the loop lower strap portion. This is effected, as illustrated in FIG. 8, by elevating the cutter member 84, in the direction of the arrow 85, through the path of the strap trailing portion.

Because the overlapping strap portions are gripped between the anvil 70 and the second gripper member 102, the restraint of the upper strap portion by the first gripper member 96 may be terminated, even before the strap trailing portion is severed. However, in the preferred embodiment illustrated, the first gripper member 96 is lowered to a third elevation position to release the upper strap portion only after the strap trailing portion has been severed.

The lowering of the first gripper member 96 to the third elevation position is illustrated in FIG. 9 wherein the downward movement of the first gripper member 96 is indicated by the arrow 112. As the gripper member 112 moves downwardly, the severed lower portion of the strap in the passageway 100 below the first gripper member 96 slides out of the passageway 100. When the gripper member 112 reaches the third, or fully retracted, position illustrated in FIG. 9, the first gripper member 96 has completely cleared the severed lower strap portion. The severed lower strap portion then, owing to its slight stiffness, springs outwardly some distance over the top of the first gripper member 96 in the direction of the arrows 114 (FIG. 9). The severed lower strap portion then assumes an outwardly extended position generally indicated in phantom lines in FIG. 9.

After the first gripper member 96 has been lowered, or as the gripper member is being lowered, the heating member 50 is extended below the upper strap portion under the anvil 70. The heating member 50 is extended in a direction generally parallel to the strap length. Preferably, the heating member 50 is cantilevered from a pivot mounting (104 in FIG. 5) as discussed above at an angle A below the horizontal. As the heating member 50 is extended below the anvil 70, the pivot mounting of the heating member 50 is also elevated so that the upper surface of the heating member 50 would be at the same elevation as the bottom surface of the upper strap portion when the heating member is subsequently pivoted upwardly through the angle A (FIG. 9).

Next, the first gripper member 96 is elevated to a fourth position as illustrated in FIG. 10 to press the lower strap portion against the heating member 50 and to press the upper strap portion between the heating member 50 and the anvil 70.

The upward force of the first gripper member 96 causes the heating member 50 to pivot upwardly through the angle A (FIG. 9) so that the heating member 50 becomes substantially parallel to the bottom surface of the anvil 70. The upward movement of the first gripper member is indicated by the arrow 116 in FIG. 10.

The gripper member 96 is typically urged against the strap portions, heating member 50, and anvil 70 as illustrated in FIG. 10 with an upward force of between about 50 and 100 pounds. This force may be provided by a suitable spring (not illustrated) acting on the gripper means 88.

The heating member 50 is maintained at a temperature sufficient to melt the adjacent surface regions of the upper and lower strap portions. The temperature of the heating member 50 may vary depending upon, inter alia, the strap material, strap thickness, welding pressure, and the duration of the contact between the heating member and strap portions. Typically, the heating member 50 is maintained at a temperature of about 800° F. for use with conventional polypropylene, or nylon strap having a conventional thickness ranging between about 0.254 mm. and about 0.889 mm. Heat may be applied also in a similar manner, but at temperatures of about 1000° F. to about 1100° F.

The overlapping strap portions are squeezed against the heating member 50 by the gripper member 96 as illustrated in FIG. 10 for a time period sufficient to effect the melting of regions of the upper and lower strap portions. The heating member 50 is maintained in the extended position between the upper and lower strap portions during this period in which melting of a region of each strap portion occurs. The time required for the desired melting to occur depends upon, inter alia, the type of strap, the upward pressure applied by the gripping member 96, the temperature of the heating member, and the depth of the melted strap region that is desired. Typically, for conventional polyester or polypropylene strap, a desired amount of melting occurs in about 15 to about 25 milliseconds after the upper and lower strap portions are squeezed against the 800° F. heating member 50 with a force ranging between about 50 and 100 pounds.

When the regions of the strap portions adjacent the heating member 50 have melted to the desired depth, the heating member 50 is withdrawn. This may be effected by terminating any positive engagement of mechanisms used for holding the heating member 50 in the extended position and by then permitting a retraction force to act upon the heating member 50. Such a retraction force may be applied by a tension spring (not illustrated), for example.

When the surface regions of the upper and lower strap portions are melted by the heating member 50, the static and dynamic sliding friction coefficients are greatly reduced. Consequently, a sufficient retracting force applied to the heating member 50 will cause the heating member 50 to be withdrawn from between the upper and lower strap portions, not withstanding the fact that the gripper member 96 is still being urged upwardly under a moderate amount of force (e.g., less than 100 pounds). A retraction force of about 25 pounds has been found to be sufficient in typical applications.

Figure 11:
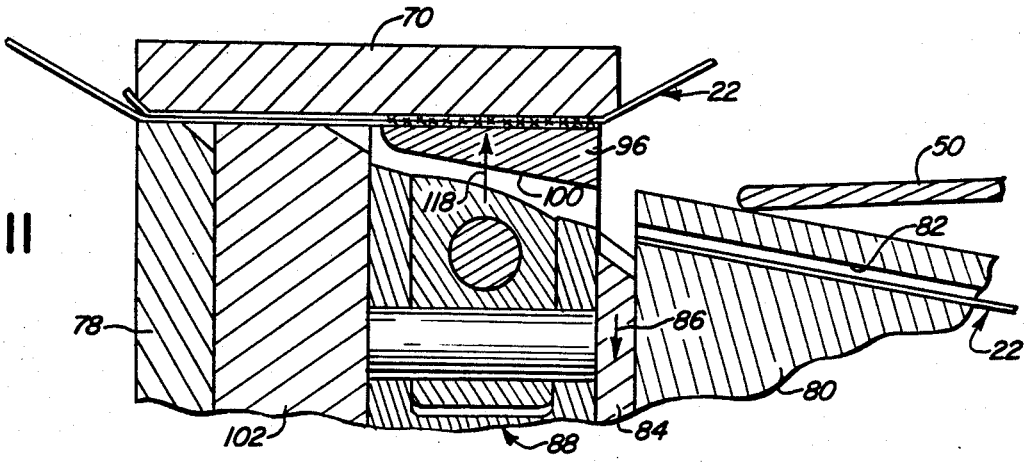

As soon as the heating member 50 has been retracted past the edge of the gripper member 96, the gripper member 96 is free to move upwardly to a fifth and final elevation position as indicated by arrow 118 in FIG. 11. The gripper member 96 presses the upper and lower strap portions together in face-to-face contact between the anvil 70 and the gripper member 96 as the melted regions of the upper and lower strap portions solidify to form a joint.

Preferably, the gripper member 96 is urged upwardly with an increased force (e.g., 500–600 pounds) as the upper and lower strap portions fuse together and as the welded joint cools. This may be effected through the use of a suitable spring (not illustrated) that is permitted to act upon the gripper means 88 during this step in the process.

The gripper member 96 is maintained in the final elevated position as illustrated in FIG. 11 for a time period sufficient to create an effective welded joint. The duration of this step may vary depending upon, inter alia, the strap material, the thickness of the strap, the tension in the strap, the temperature to which the strap had been heated, and the desired depth of the weld in each strap portion. Typically, the upper and lower strap portions are squeezed together by the gripper member 96 with about 500–600 pounds of compressive force for a period of time ranging between about 20 milliseconds and about 600 milliseconds.

Figure 12:
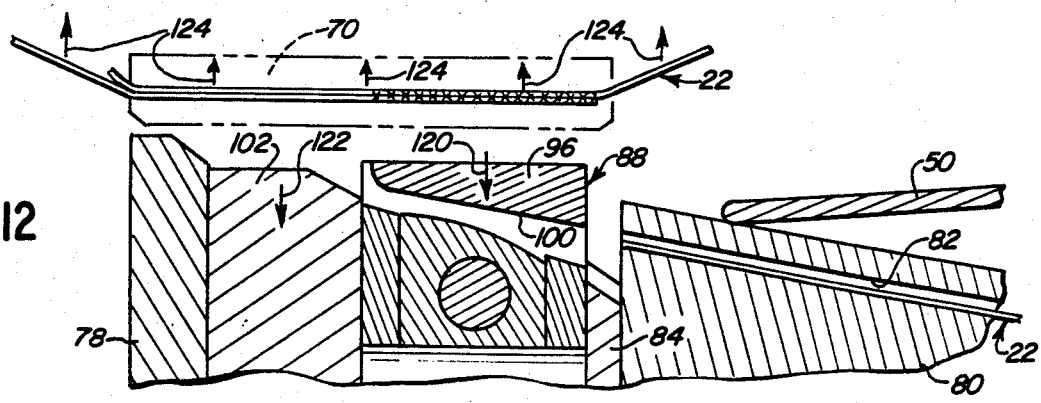

After the welded joint has been properly formed between the overlapping strap portions, and after the welded joint has cooled sufficiently, the gripper means 88, gripper member 102, and cutting member 84 are retracted to the lower, initial positions as illustrated in FIG. 12. If desired, downward movement of the cutter member 84 may be initiated any time after it has been elevated to sever the strap trailing portion.

In the embodiment of the method illustrated, the downward movement of the cutter member 84 is initiated as the gripper member 96 is being raised to squeeze the overlapping strap portions together (FIG. 11). In any event, the cutter member 84 is eventually returned to the initial, lowered position illustrated in FIG. 12.

Similarly, the gripper means 88 is lowered in the direction of arrow 120 to the initial position as illustrated in FIG. 12, and the gripper member 102 is lowered in the direction of arrow 122 to the initial position as illustrated in FIG. 12. At the time the gripper means 88 and gripper member 102 are lowered, the anvil 70 is retracted. Alternatively, once the gripper member 96 has been lowered away from the welded joint, then the anvil 70 may be retracted either before or after, as well as during, the lowering of the gripper means 88 and gripper member 102. When the anvil 70 is retracted, the tensioned and welded strap loop slips off the end of the anvil 70 and snaps upwardly (in the direction of the arrows 124 in FIG. 12) tight against the bottom of the object being bound.

The above-described method for providing a tensioned loop results in the production of a good welded joint. The welded joint has a substantially uniform depth through the strap transverse cross section at any point along the joint length. The method permits the employment mechanisms in an automatic power strapping machine for producing such a welded joint and the method permits such an automatic power strapping machine to have a relatively narrow configuration (as measured normal to the plane of the strap loop). This permits a conveyor system or another strapping machine to be placed relatively close.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A method for providing a tensioned loop of thermoplastic strap around an object, said method comprising the steps of:

(a) feeding said strap to form said loop with overlapping upper and lower strap portions and a trailing portion of strap extending from said loop, said upper strap portion extending over a first gripper member and below an anvil, said lower strap portion extending below at least a portion of said first gripper member, and both said upper and lower strap portions extending above a second gripper member below said anvil;

(b) restraining said upper strap portion by elevating said first gripper member between said upper and lower strap portions to press said upper strap portion against said anvil to grip said strap;

(c) pulling the strap trailing portion to tension said loop while effecting step (b) to restrain said upper strap portion;

(d) before terminating steps (b) and (c), elevating said second gripper member to press together said upper and lower strap portions against said anvil to hold said loop in tension during the subsequent steps (e–j);

(e) severing the trailing portion of the strap from said loop lower strap portion;

(f) lowering said first gripper member below the severed lower strap portion;

(g) extending a heating member between said upper and lower strap portions below said anvil and in a direction parallel to the strap length;

(h) elevating said first gripper member to press said lower strap portion against said heating member and to press said upper strap portion between said heating member and said anvil whereby regions of said upper and lower strap portions melt;

(i) withdrawing said heating member from between said upper and lower strap portions; and (j) further elevating said first gripper member to press said strap portions together in face-to-face contact between said anvil and said first gripper member as the melted regions of said upper and lower strap portions solidify to form a joint.

2. The method in accordance with claim 1 in which said step (e) includes elevating a cutter member to sever the trailing portion of the strap and in which said step (j) also includes lowering said cutter member as said first gripper member is being elevated.

3. The method in accordance with claim 1 further including a further step (k) after step (j) of lowering said first and second gripper members and withdrawing said anvil from said tensioned strap loop.

4. The method in accordance with claim 1 in which step (e) includes severing the trailing portion of the strap prior to terminating step (c).

5. A strap gripping and sealing assembly for use in a strapping machine of the type that has (1) means for feeding thermoplastic strap around an object to form a loop having upper and lower strap portions and a trailing portion of strap extending from said loop and (2) means for pulling said strap trailing portion to tension said strap loop about said object, said assembly comprising:

(a) an anvil on said machine adjacent a path in which said upper and lower strap portions can be positioned;

(b) one gripper means on said machine for being moved (1) away from said anvil to accommodate the feeding of said upper and lower strap portions above said one gripper means and (2) toward said anvil to urge said lower strap portion against said upper strap portion and to urge both said strap portions upwardly to grip both said strap portions together between said one gripper means and said anvil;

(c) a movable cutter means on said machine for severing said strap trailing portion from said lower strap portion;

(d) a heating member on said machine for melting regions of said upper and lower strap portions, said heating member being movable in directions parallel to the strap length between an extended position in registry with said anvil and a retracted position out of registry with said anvil; and (e) another gripper means on said machine for being initially positioned between said upper and lower strap portions and for subsequently being moved sequentially (1) toward said anvil to urge said upper strap portion against said anvil, (2) then away from said anvil to a position below the severed lower strap portion, and (3) then toward said anvil to press said lower strap portion against said heating member and to press said upper strap portion between said heating member and said anvil, said other gripper means being disposed between said one gripper means and said cutter means, and said other gripper means also defining a strap length receiving region below at least a portion of said other gripper means for initially accommodating said lower strap portion.

6. The assembly in accordance with claim 5 in which said other gripper means includes a movable support carried on said machine and a block pivotally mounted to said support for rotation about an axis generally parallel to the length of the strap, in which said other gripper means also includes a gripper member pivotally mounted to said block for rotation about an axis generally normal to the strap length, and in which said gripper member and said block cooperate to define a passageway in said strap length receiving region below said gripper member for receiving and guiding said lower strap portion.

7. The assembly in accordance with claim 5 in which said anvil is movable generally normal to the strap length between (1) an extended position below which said upper and lower strap portions can be positioned and (2) a retracted position spaced from said upper and lower strap portions.

* * * * *